US005599022A

United States Patent [19]

Ben-Horin

[11] Patent Number: 5,599,022

[45] Date of Patent: Feb. 4, 1997

[54] BOARD GAME FOR TEACHING MUSICAL NOTATIONS

[76] Inventor: Shoshana Ben-Horin, 22736 Carsamba Dr., Calabasas, Calif. 91302

[21] Appl. No.: 654,162

[22] Filed: May 28, 1996

[51] Int. Cl.[6] ..... A63F 3/00

[52] U.S. Cl. ..... 273/243

[58] Field of Search ..... 273/242, 243, 273/248, 249; 434/128, 129

[56] References Cited

U.S. PATENT DOCUMENTS 4,061,337 12/1977 Callender ..... 273/243
5,131,663 7/1992 Klein ..... 273/243 X

FOREIGN PATENT DOCUMENTS 2250207 6/1992 United Kingdom ..... 273/243

*Primary Examiner*—William E. Stoll

[57] ABSTRACT

A game for teaching notations including a first game board bearing a representation of musicland. Also, a plurality of lost note game cards are included. Each lost note card forms two sets of game cards with a front face that has different symbols. Additionally, a second game board bearing a representation of a haunted island is provided. The second game board has a plurality of game squares. Included is a first set of flash cards to match a second portion of the game squares of the second board. Four soldier display cards are used for placement of the first set of flash cards once they are removed from the second game board. Lastly, a third game board bearing a representation of a mysterious dungeon is included. The third game board has a plurality of dungeon squares and a second set of flash cards for positioning on the dungeon squares. Included are six song display cards that allow the second set of flash cards to be placed thereon, once they are removed from the third game board. Furthermore, at least four soldier playing pieces are provided to indicate the position of a player during game play.

10 Claims, 6 Drawing Sheets

BOARD GAME FOR TEACHING MUSICAL NOTATIONS

BACKGROUND OF THE INVENTION

1. Field of the Invention

The present invention relates to a board game for teaching musical notations and more particularly pertains to using an adventure motif to teach children music basics.

2. Description of the Prior Art

The use of a board game for teaching music is known in the prior art. More specifically, board games for teaching music heretofore devised and utilized for the purpose of musical instruction are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,895,374 to Boles discloses a board game for teaching music. U.S. Pat. No. 4,465,282 to Dillon discloses a musical symbol educational game. U.S. Pat. No. 4,736,665 to Sorribes Arambul discloses a musical language game. U.S. Pat. No. 4,787,639 to Ross discloses a game of chance. U.S. Pat. No. 3,994,500 to Schow discloses a musical composition board game. Lastly, U.S. Pat. No. 4,336,935 to Goldfarb discloses a musical game apparatus.

While these devices fulfill their respective, particular objectives and requirements, the aforementioned patents do not describe board game for teaching musical notations that allows children to learn musical notes and some musical definitions while having fun playing the board game.

In this respect, the board game for teaching musical notations according to the present invention substantially departs from the conventional concepts and designs of the prior art, and in doing so provides an apparatus primarily developed for the purpose of using an adventure motif to teach children music basics.

Therefore, it can be appreciated that there exists a continuing need for a new and improved board game for teaching musical notations which can be used for using an adventure motif to teach children music basics. In this regard, the present invention substantially fulfills this need.

SUMMARY OF THE INVENTION

In view of the foregoing disadvantages inherent in the known types of board games for teaching music now present in the prior art, the present invention provides an improved board game for teaching musical notations. As such, the general purpose of the present invention, which will be described subsequently in greater detail, is to provide a new and improved board game for teaching musical notations and method which has all the advantages of the prior art and none of the disadvantages.

To attain this, the present invention essentially comprises a first generally rectangular game board bearing a representation of musicland with high mountains and a valley therebetween. Included are a plurality of lost note game cards for matching during game play, when placed on the first game board. Each lost note card has a front face divided into two sections. One set of the lost note cards has a staff with a note represented on each section. Another set of the lost note cards has a shield on an upper section and the staff with the note on a lower section. Also, a second generally rectangular game board bearing a representation of a haunted island near musicland is provided. The second game board has a plurality of game squares with one game square as the the starting square. A first portion of the game squares have a blank interior. A second portion of the game squares have a staff with notes thereon. A third portion of the game squares have musical terms. Included are a first set of flash cards. Each of the first set of flash card bears a single musical note on a bottom side and a corresponding identifying symbol of the musical note on a top side. Each of the first set of flash cards is matched with the game squares of the second portion of the second board. Each of the first set of flash cards, when matched, have the bottom side placed on the matching game square prior to game play. Four generally rectangular soldier display cards are provided. Each soldier display card has a shield and flash card space holders. The flash card space holders of the soldier display cards are numbered. The flash card space holder allow the first set of flash cards to be placed thereon, once they are removed from the second game board during game play. Lastly, a third generally rectangular game board is included. The third game board bears a representation of a mysterious dungeon on the haunted island near musicland. The third game board has a plurality of dungeon squares. One set of the dungeon squares is blank while another set of the dungeon squares have directions for game play. Furthermore, a second set of flash cards are provided. Each second set of flash cards bear a staff with a musical note on a bottom side and dragon indicia on a top side. Each of the second set of flash cards is positionable on the blank dungeon squares of the third game board. Each of the second set of flash cards have the staff side facing the blank dungeon square prior to game play. Included are six generally rectangular song display cards. Each song display card has a stanza of a song and flash card space holders. The flash card space holders of the song display cards are numbered. The flash card space holders allow placement of the second set of flash cards thereon, once they are removed from the third game board during game play. At least four soldier playing pieces are included. The soldier playing pieces are for positioning on the second and third game board to indicate the position of a player during game play. Each soldier playing piece is a color. Finally a die that has six sides and carrying numerals on its respective sides, is porvided. The die is rolled to controll the start of game play. The die is rolled to controll the movement of the soldier pieces along the second and third game board.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved board game for teaching musical notations which has all of the advantages of the prior art board games for teaching music and none of the disadvantages.

It is another object of the present invention to provide a new and improved board game for teaching musical notations which may be easily and efficiently manufactured and marketed.

It is further object of the present invention to provide a new and improved board game for teaching musical notations which is of durable and reliable constructions.

An even further object of the present invention is to provide a new and improved board game for teaching musical notations which is susceptible of a low cost of manufacture with regard to both materials and labor, and which accordingly is then susceptible of low prices of sale to the consuming public, thereby making such board game for teaching musical notations economically available to the buying public.

Still yet another object of the present invention is to provide a new and improved board game for teaching musical notations which provides in the apparatuses and methods of the prior art some of the advantages thereof, while simultaneously overcoming some of the disadvantages normally associated therewith.

Even still another object of the present invention is to provide a board game for teaching musical notations for using an adventure motif to teach children music basics.

Lastly, it is an object of the present invention to provide a new and improved game for teaching notations including a first game board bearing a representation of musicland. Also, a plurality of lost note game cards are included. Each lost note card forms two sets of game cards. The game card of each set has a front face with different symbols. Additionally, a second game board bearing a representation of a haunted island is provided. The second game board has a plurality of game squares with one game square as the starting square. Included is a first set of flash cards to match a second portion of the game squares of the second board. Four soldier display cards are used for placement of the first set of flash cards once they are removed from the second game board. Lastly, a third game board bearing a representation of a mysterious dungeon on the haunted island is included. The third game board has a plurality of dungeon squares and a second set of flash cards for positioning on the dungeon squares. Included are six generally rectangular song display cards that allow the second set of flash cards to be placed thereon, once they are removed from the third game board. Furthermore, at least four soldier playing pieces are provided and positionable on the second and third game board to indicate the position of a player during game play.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
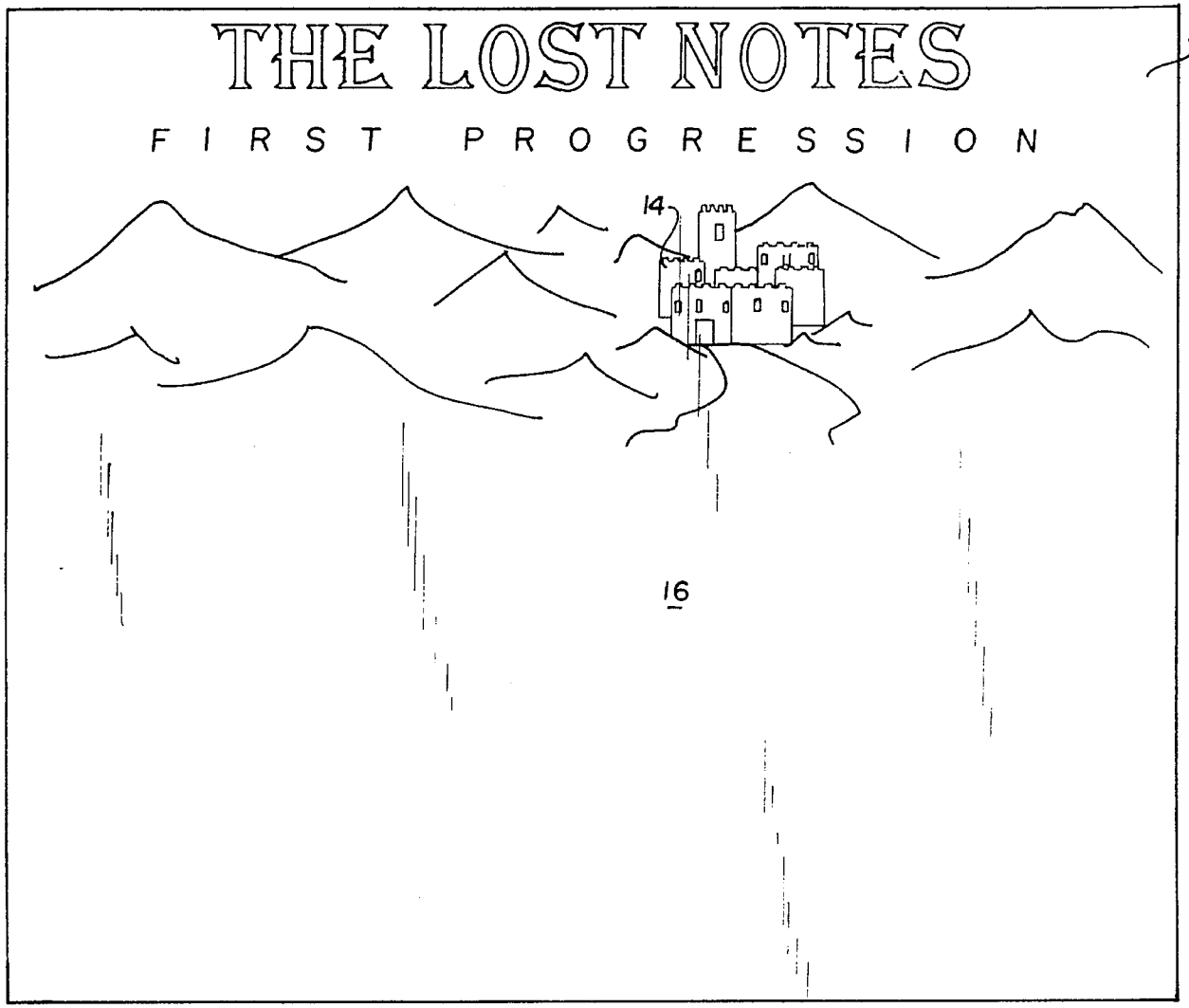
FIG. 1 is a top plan view of the first game board constructed in accordance with the principles of the present invention.
Figure 4:
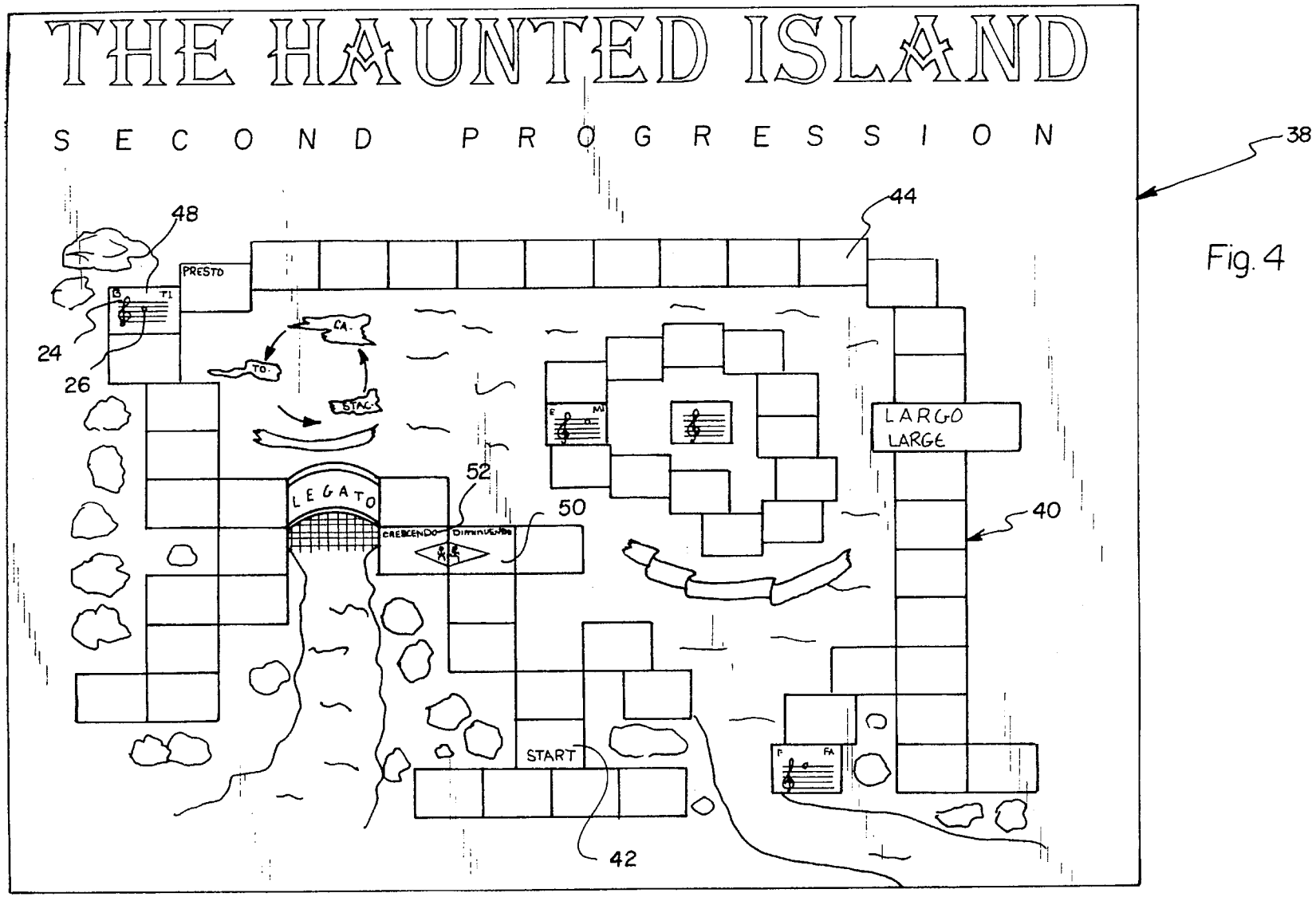
FIG. 4 is top plan view of the second game board constructed in accordance with the principles of the present invention.
Figure 8:
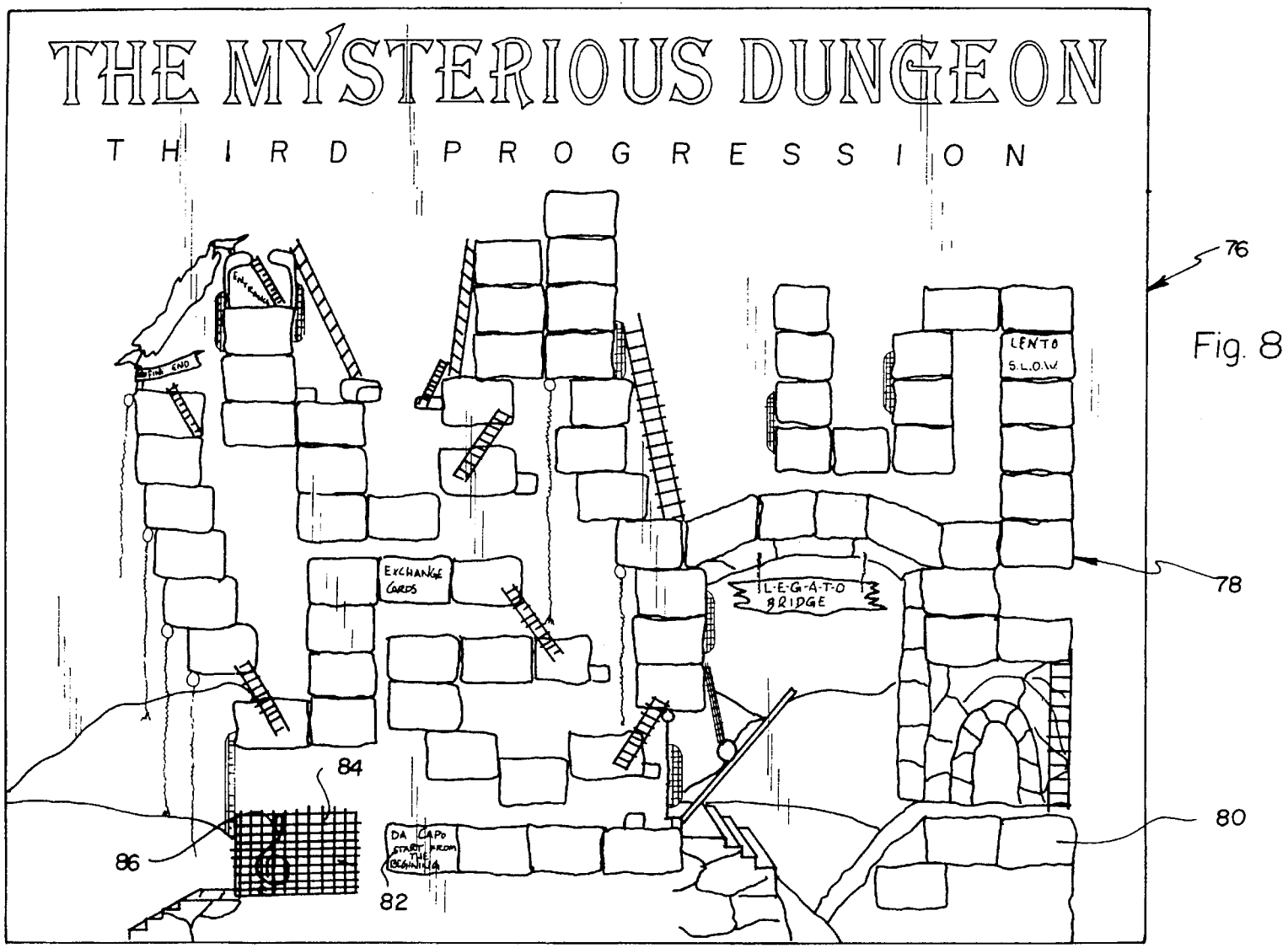
FIG. 8 is a top plan view of the third game board constructed in accordance with the principles of the present invention.
Figure 9:
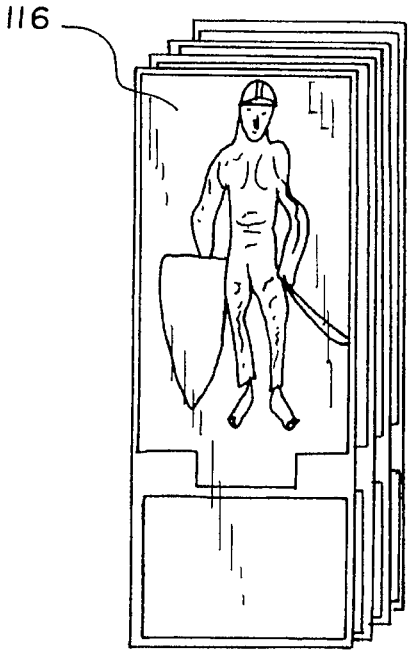
FIG. 9 is an isometric view of the solider playing pieces of the present invention for use on the second and third game boards.
Figure 10:
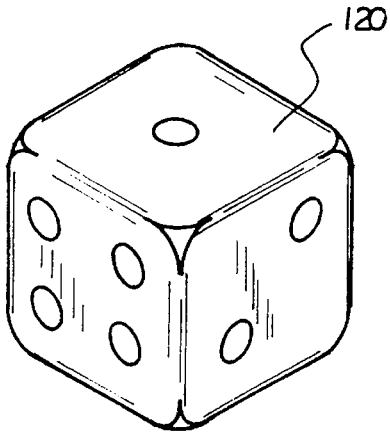
FIG. 10 is an isometric view of the die of the present invention.
Figure 11:
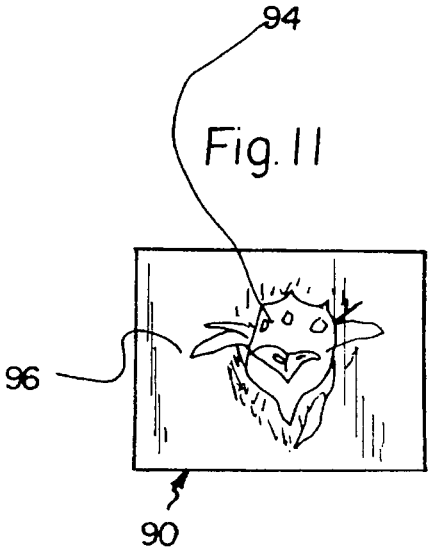
FIG. 11 is a top view of the dungeon game cards of the present invention.
Figure 12:
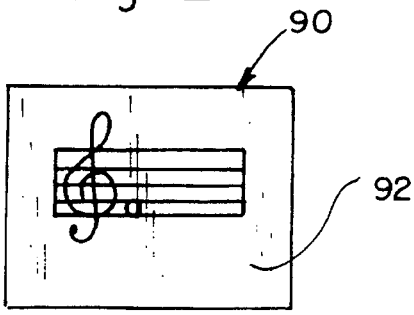
FIG. 12 is a bottom view of the dungeon game cards of the present invention

With reference now to the drawings, and in particular to FIGS. 1, 4 and 8 thereof, the preferred embodiment of the new and improved board game for teaching musical notations embodying the principles and concepts of the present invention and generally designated by the reference numeral 10 will be described.

The present invention, the board game for teaching musical notations 10 is comprised of a plurality of components. Such components in their broadest context includes three game boards, game pieces, game cards and a die. Such components are individually configured and correlated with respect to each other so as to attain the desired objective.

Specifically, the present invention includes a first generally rectangular game board 12 that bears a representation of musicland 14. As seen in FIG. 1, musicland is surrounded by high mountains and sits in a valley. Just below musicland is a playing area 16. The first game board is the first progression of the game.

Figure 2:
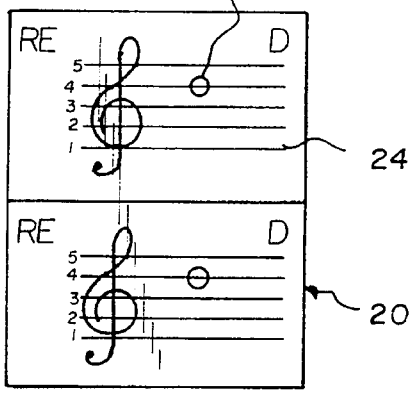
FIG. 2 is a top plan view of one set of the lost note game cards of the present invention.
Figure 3:
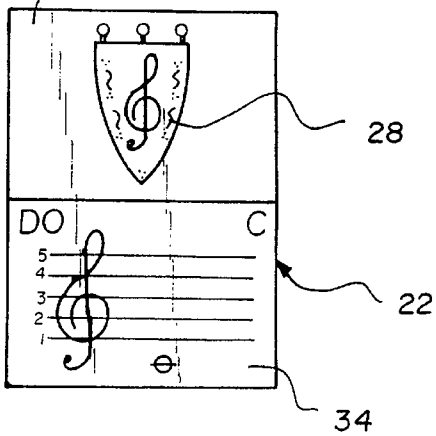
FIG. 3 is a top plan view of another set of the lost note game cards of the present invention.

Also, a plurality of lost note game cards are included. The lost note game cards are matched during game play and placed on the first game board. The plurality of lost note game cards consists of the two sets of lost note game cards 20 and 22. Each lost note game card of both sets have a front face divided into two sections. One set 20 of the lost note game cards has a staff 24 with a musical note 26 represented on each section, as seen in FIG. 2. Another set 22 of the lost note game cards has a shield 28 on an upper section 32, and the staff with the note on a lower section 34, as seen in FIG. 3. One of the lost note game cards is placed in the middle of the playing area of the first game board at the beginning of the first progression of the game.

The second progression of the game is played on a second generally rectangular game board 38. The second game board has a representation of a haunted island near musicland. The haunted island is surrounded by water and covered with brush. The second game board has a plurality of game squares 40, with one game square as the starting square 42, as seen in FIG. 4. The plurality of game squares are grouped into three portions. A first portion 44 of the game squares has a blank interior. A second portion 48 of the game squares has a staff 24 with a note 26 thereon. A third portion 50 of the game squares has musical terms 52 thereon.

Figure 6:
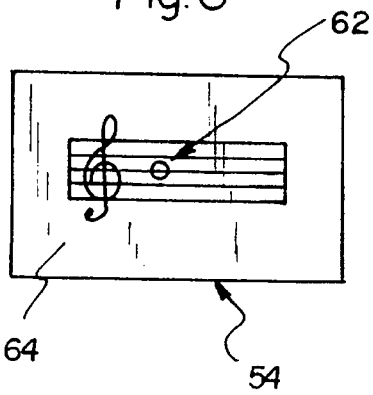
FIG. 6 is a top view of the first set of flash cards of the present invention.
Figure 7:
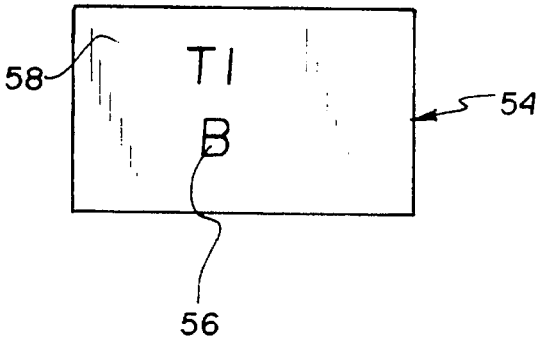
FIG. 7 is a bottom view of the first set of the flash cards of the present invention.

As best illustrated in FIGS. 6 and 7, a first set of flash cards 54 are included. Each of the first set of flash cards bears a single musical note 56 on a bottom side 58 and a corresponding identifying symbol 62 of the musical note on a top side 64. Each of the first set of flash cards is matched with the game squares of the second portion of the second board. Each of the first set of flash cards, when matched, are placed on the matching game square prior to game play. Each of the first set of the flash cards is placed in the second portion of the game squares with the bottom side down. As the game is played, the top side faces the game players.

Figure 5:
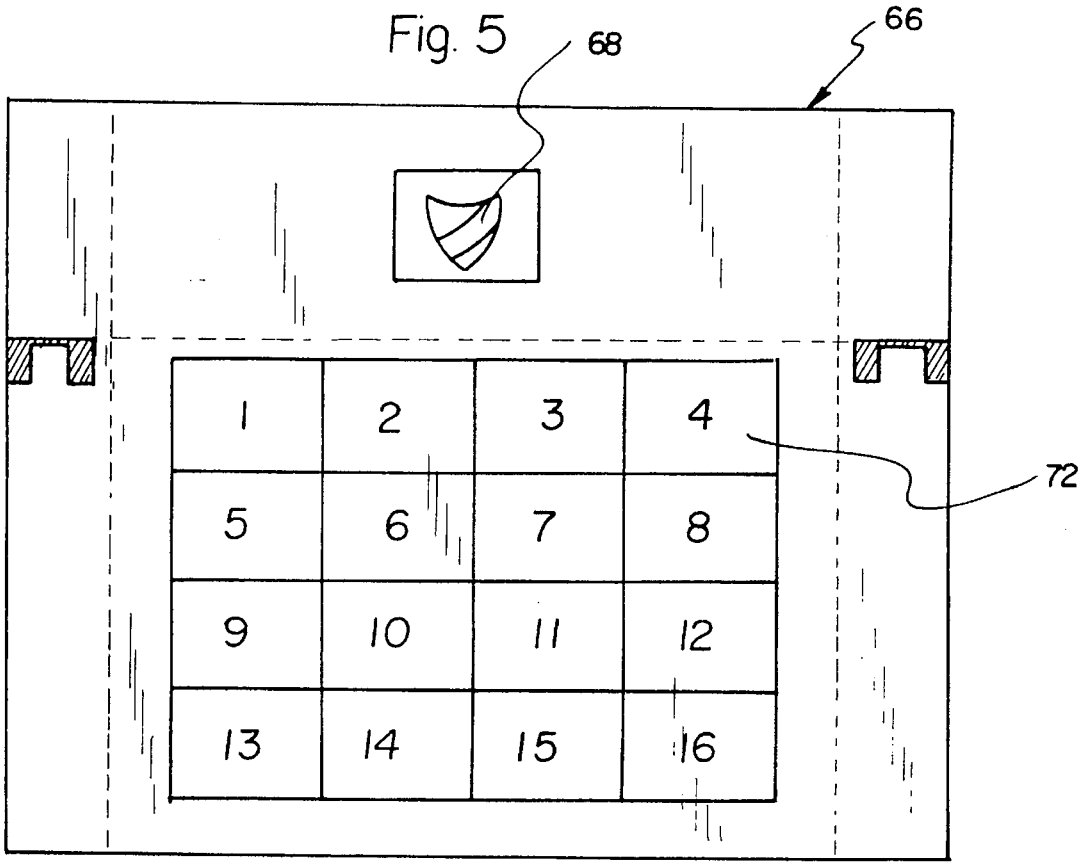
FIG. 5 is a plan view of the soldier display cards for use when playing on the second game board of the present invention.

Four generally rectangular solider display cards 66 are provided. As shown in FIG. 5, each solider display card has a shield 68 and flash card spaced holders 72. The flash card spaced holders of the solider display cards are numbered. The first set of the flash cards are placed on the place holders once they are removed from the second game board during game play. When the game is being played, the first flash cards are removed from the game squares of the second game board 38. It is desirous that the first flash cards be arranged on each solider display card in scale order.

Additionally, a third generally rectangular game board 76 is included. The third game board is used in the third progression of game play. The third progression is the final part of game play. The third game board, as shown in FIG. 8, bears a representation of a mysterious dungeon on the haunted island near musicland 14. The third game board has a plurality of dungeon squares 78. The dungeon squares are two sets. One set of the dungeon squares being blank 80. Another set of the dungeon squares having directions 82 for game play. Located in the jail 84 of the dungeon is Princess Sol 86, the person to be recused during game play.

Included are a second set of flash cards 90. The second set of flash cards each bear the staff 24 and a note 26 on the bottom side 92 and dragon indicia 94 on the top side 96. Each of the second set of the flash cards are placed on the blank dungeon squares of the third game board. Each of the second set of flash cards, when placed on the third game board, are placed with the staff side facing down. The second set of flash cards are placed on the blank dungeon squares prior to game play.

Figure 13:
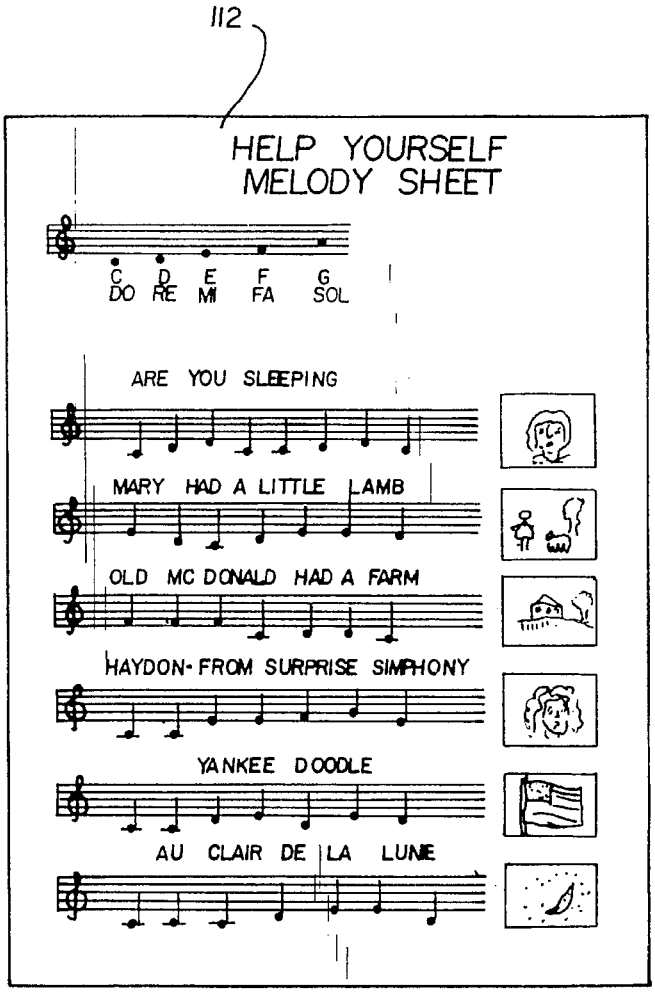
FIG. 13 is a top plan view of the help yourself display card of the present invention.
Figure 14:
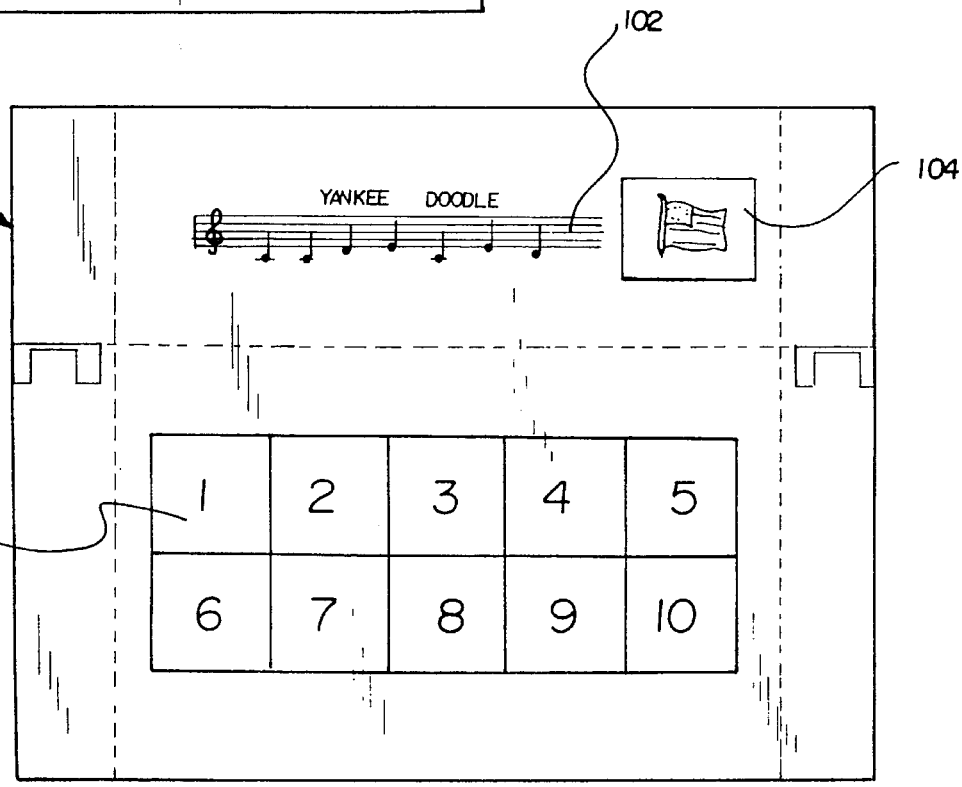
FIG. 14 is a top view of the song display card of the present invention for use with the third game board.

To play the third progression of the game, six generally rectangular song display cards 100 are needed. Each song display card has a stanza 102 of a song thereon, a symbol for the song 104 and flash card space holders 106. The song stanza on each card matches one of the songs on a help yourself display card 112. The help yourself display card, as seen in FIG. 13, may be used during the third progression of the game play. The flash card space holders of the song display card are numbered. The second set of flash cards are placed on the flash card space holders once they are removed from the third game board during game play.

Lastly, at least four solider playing pieces 116 are provided. The solider playing pieces are positioned on the second and third game boards to indicate the position of a player during game play. Each solider playing piece has a color. In the second progression of the game, the color of each solider playing pieces matches the color of one of the shields on the solider display cards.

Furthermore, a die 120 is included. The die has six sides and carries numerals on its respective sides. The die, when rolled, controls the start of game play by deciding which player goes first. The die, when rolled during each game, controls the movement of the solider pieces along the second and third game board.

RULES

The following set of rules are provided as preferred manner of playing the game. However, variation of rules and manner of playing the game are within the scope of this invention.

The game of the present invention is played in three progression. Each progression requires its own game board for game play. The die of the game is used in all three progressions of game play. The solider pieces are used in the second and third progressions of game play.

First Progression

Game pieces Twenty-eight lost game cards and the first game board.

How to start the first progression:

Pass out four lost note game cards to two or four players.

The rest of the lost note game cards are piled up face down to the side of the first game board.

A card is taken from the pile of lost note game cards and placed in the middle of the playing area with the note side facing up.

Each player takes a turn rolling the die, the player with the highest score on the die starts the game.

The starting player attempts to match one of his cards with the card that is face up on the playing area of the first game board. If that player does not have a matching card, the player must choose one of the lost note game cards from the pile adjacent the first game board. If the chosen card does not match the card facing up in the playing area, the next player will proceed in the game.

Game play continues with each player attempting to, first match one of the lost note cards in his hand with the lost note card facing upward on the playing area of the first game board. Whenever a player cannot match a card from his hand, the player must choose one of the lost note game cards from the pile of lost note game cards. After chosing a lost not game card from the pile of cards, the player will attempt to match it with the card on the playing area. If the player does not have a matching lost note card, the game proceeds with next player. On some of the lost note game cards, a symbol depicting Princess Sol is displayed. This symbol may be used to stand in for any note that the player wants it to stand for. The winner of the first progression is the player who displays all of his cards first, by getting rid of them, or the player with the least number of cards left.

Second Progression

Game Pieces

A second game board.

A first set of flash cards numbering twenty-six.

Four solider display cards.

Four solider playing pieces.

How to Set-up the Second Game Board:

Divide the first set of flash cards into two groups of thirteen cards each. Arrange each group of thirteen cards on top of the second portion of the game squares having staff and notes, with the card from the first set of flash cards being matched with the note on the second game board. Each game square of the second game board that has a staff and note should have at least two of the flash cards, that match, placed thereon. Next, place a solider display card near each player.

Rules of the Second Progression:

The player with the highest number on the die starts the game. Roll the die and move the number of squares shown on the die. Some of the squares, the player will stop on, will have directions for the player to follow. If the player stops on a square with a note drawn on it, the player will free one of Princess Sol's soldiers. Take the matching flash card on the haunted island and put it the player's soldiers display card with the note facing up. The player is only allowed one card per turn. Each player should try and get as many flash cards in a row and arrange them in according to a musical scale. The winner is the player who completes the most number of consecutive cards. The second progression of the game allows the game players to become familiar with the names and positions of the musical notes. Also, it gets the player familiar with some of the musical definitions.

Third Progression

Game pieces

Third game board

Six song display cards

Four solider pieces

Second set of flash cards numbering forty-nine

How to Set-up the Third Game Board:

Arrange the second set of the flash cards with the notes facing down on the blank dungeon squares of the third game board. Place a song display card near each of the game players, with the player holding the cards so no one can see it.

Rules of the Third Progression:

The player with the highest number on the die starts the game. The first player moves the solider piece in a direction on the dungeon squares according to the number that is shown on the die. As the player progresses about the third game board, some of the squares the player will land will have directions for the player to follow. When moving from one dungeons square to another dungeon square, the player is to use the ladders shown on the game board. When a player stops on one of the second set of flash cards, the player is to pick the card and try to name the note. If the player has correctly named the note, one of Princess Sol's is freed from the dragon's power. The flash card is then placed face up on the song display card board. If the player, having landed on one of the flash cards of the second set of flash cards, and is unable to name the note, the player may use the help yourself display card.

At the end of the second progression the player that wins receives a bravery brag certificate. The player that wins the third progression of the game receives a nobility rank award for getting Princess Sol out of the prison.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the U.S. is as follows:

1. A new and improved board game for teaching musical notations comprising in combination:

a first generally rectangular game board bearing a representation of musicland with high mountains and a valley therebetween;

a plurality of lost note game cards for matching during game play while being placed on the first game board, each lost note card having a front face divided into two sections, one set of the lost note cards having a staff with a note being represented on each section, another set of the lost note cards having a shield on an upper section and the staff with the note on a lower section;

a second generally rectangular game board bearing a representation of a haunted island near musicland, the second game board having a plurality of game squares with one game square being the starting square, a first portion of the game squares having a blank interior, a second portion of the game squares having a staff with notes thereon, and a third portion of the game squares having musical terms thereon;

a first set of flash cards each bearing a single musical note on a bottom side and a corresponding identifying symbol of the musical note on a top side, each of the first set of flash cards being matched with the game squares of the second portion of the second board, each of the first set of flash cards, when matched having the bottom side being placed on the matching game square prior to game play;

four generally rectangular soldier display cards, each soldier display card having a shield and flash card space holders, the flash card space holders of the soldier display cards being numbered and capable of having the first set of flash cards placed thereon once they are removed from the second game board during game play;

a third generally rectangular game board bearing a representation of a mysterious dungeon on the haunted island near musicland, the third game board having a plurality of dungeon squares, one set of the dungeon squares being blank while another set of the dungeon squares having directions for game play;

a second set of flash cards each bearing a staff with a musical note on a bottom side and dragon indicia on a top side, each of the second set of flash cards being positionable on the blank dungeon squares of the third game board, each of the second set of flash cards having the staff side facing the blank dungeon square prior to game play;

six generally rectangular song display cards, each song display card having a stanza of a song thereon and flash card space holders, the flash card space holders of the song display cards being numbered and capable of having the second set of flash cards placed thereon once they are removed from the third game board during game play;

at least four soldier playing pieces for positioning on the second and third game board to indicate the position of a player during game play, each soldier playing piece being a color; and a die having six sides and carrying numerals on its respective sides, the die being rolled for controlling the start of game play, the die being rolled for controlling the movement of the soldier pieces along the second and third game board.

2. A game for teaching notations comprising:

a first game board bearing a representation of musicland;

a plurality of lost note game cards for matching during game play, the lost note cards forming two sets of game cards with the game card of each set having a front face with different symbols;

a second game board bearing a representation of a haunted island near musicland, the second game board having a plurality of game squares with one game square being the starting square;

a first set of flash cards for matching to a second portion of the game squares of the second board;

four soldier display cards capable of having the first set of flash cards placed thereon once they are removed from the second game board;

a third generally rectangular game board bearing a representation of a mysterious dungeon on the haunted island, and having a plurality of dungeon squares;

a second set of flash cards for positioning on the dungeon squares;

six generally rectangular song display cards capable of having the second set of flash cards placed thereon once they are removed from the third game board; and at least four soldier playing pieces for positioning on the second and third game board to indicate the position of a player during game play.

3. The game as set forth in claim 2, wherein the front face of one set of the lost note cards being divided into two sections, each section of the one set having a staff with a note being represented thereon, the front face of another set of the lost note cards being divided into an upper section and a lower section, the upper section of the other set having a shield thereon and the lower section of the other set having the staff with the note thereon.

4. The game as set forth in claim 2, wherein the game squares of the second game board forming a first portion and a third portion along with the second portion, the first portion of the game squares having a blank interior, the second portion of the game squares having a staff with notes thereon, and the third portion of the game squares having musical terms thereon.

5. The game as set forth in claim 4, wherein each first set of flash cards bearing a single musical note and a corresponding identifying symbol of the musical note, and each of the first set of flash cards, when matched to a second portion of the game squares, having the bottom side being placed thereon prior to game play.

6. The game as set forth in claim 2, wherein each of the soldier display cards having a shield, and each of the soldier display cards having flash card space holders being numbered.

7. The game as set forth in claim 2, wherein one set of the dungeon squares of the third game board being blank, while another set of the dungeon squares having directions for game play.

8. The game as set forth in claim 7, wherein each of the second set of flash cards bearing a staff with a musical note on a bottom side and dragon indicia on a top side, and each of the second set of flash cards having the staff side facing the blank dungeon squares of the third game board when positioned thereon prior to game play.

9. The game as set forth in claim 2, wherein each song display card having a stanza of a song thereon and flash card space holders being numbered.

10. The game as set forth in claim 9, including a die having six sides, each side of the die carrying numerals on its respective sides, the die being rolled for controlling the start of game play, the die being rolled for controlling the movement of the soldier pieces along the second and third game board.

* * * * *